United States Patent [19]

Rybak et al.

[11] Patent Number: 5,000,405

[45] Date of Patent: Mar. 19, 1991

[54] FIRE HOSE STABILIZER

[76] Inventors: Laurence P. Rybak, 3020 71st St., Woodridge, Ill. 60517; Paul E. Rybak, 3675 N. Beth Dr., Morris, Ill. 60450; Allen L. Fane, 202 Park St., Earlville, Ill. 60518

[21] Appl. No.: 466,840

[22] Filed: Jan. 18, 1990

[51] Int. Cl.[5] ..... A47G 29/00

[52] U.S. Cl. ..... 248/80; 248/79; 248/910

[58] Field of Search ..... 248/80, 75, 76, 79, 248/910, 688; 169/51

[56] References Cited

U.S. PATENT DOCUMENTS

| | | | |
|---|---|---|---|
| 596,689 | 1/1898 | Aungst | 248/75 |
| 2,045,336 | 6/1936 | Skoglund | 248/75 UX |
| 2,464,366 | 3/1949 | Bakke | 248/80 X |
| 3,119,587 | 1/1964 | Anderson | 248/75 |
| 4,187,913 | 2/1980 | Wilcox | 285/162 X |
| 4,296,693 | 10/1981 | Archer | 248/158 X |
| 4,470,177 | 9/1984 | Ganung et al. | 248/75 X |

*Primary Examiner*—Ramon O. Ramirez
*Attorney, Agent, or Firm*—Ernest Kettelson

[57] ABSTRACT

An apparatus for holding a pressurized fire hose with water flowing therethrough comprising an enclosure having a cavity therein, a centered aperture therethrough isolated from the cavity by a cylindrical wall extending from the front wall to the rear wall of the enclosure, two slots extending from the aperture to receive corresponding finger projections of a hose coupling and a depressured fire hose connected thereto to pass through the enclosure, the coupling then being rotated ninety degrees to maintain the position of the coupling and fire hose assembly, and an aperture through the front wall of the enclosure to allow a ballast material to be inserted in the cavity thereby providing weight to the enclosure to keep the fire hose stationary.

10 Claims, 7 Drawing Sheets

FIRE HOSE STABILIZER

BACKGROUND OF THE INVENTION

This invention relates to the field of fire hose stabilizers, and in particular to stabilizers which fit on the nozzle end of a fire hose thereby preventing the nozzle from "whipping" about and injuring someone.

Prior art fire hose stabilizers have been aimed at utilizing a clamp that surrounds the fire hose with a handle on top of the clamp to act as a hand grip for firemen when fighting a fire to resist the back pressure acting on the hose and thereby provide for greater ease in directing the nozzle of the hose toward the fire. Another prior art fire hose stabilizer requires a support structure, typically a wall, which the stabilizer clamps upon to hold the fire hose nozzle in place without any firemen holding the fire hose.

The problem with prior art fire hose stabilizers is that they still require two or three firemen to operate a typical three inch diameter fire hose, or they require a wall to clamp upon. No prior art fire hose stabilizer design allows one fireman to control the fire hose-nozzle assembly and direct water flow at different directions for maximum fire quenching capability.

Examples of prior art devices include those disclosed in the following United States patents:

U.S. Pat. No. 4,427,074 discloses an impeller connected to a liquid powered motor that mounts to a liquid carrying conduit. Water forced through the conduit drives the liquid powered motor which rotates the impeller. The impeller is capable of moving a large volume of air that combines with water discharged from the liquid powered motor, and water from the conduit thereby providing a fine mist that blankets a burning area and controls the flow of smoke and poisonous gases. One problem with this device is that it cannot provide a stream of water to a distant location due to the misting feature. Another problem is that more than one fireman would be required to operate the system if a three inch diameter hose acted as the liquid carrying conduit.

U.S. Pat. No. 4,470,177 discloses a fire hose clamp with a hand grip for firemen for use on a fire hose when fighting a fire to resist the back pressure acting on the hose and thereby provide greater ease in directing the nozzle of the hose toward the fire. The problem with this device is that a typical three inch diameter fire hose would still require two or more firemen to operate the fire hose-nozzle assembly.

U.S. Pat. No. 4,393,941 discloses a chimney fire snuffer having a tapered impact section and an opposite end bearing section with threads to receive a garden hose. The plurality of spray nozzles in the impact section allows water from the garden hose to discharge through the impact section thereby forming a mist that blankets a chimney fire started due to buildup of creosote.

U.S. Pat. No. 4,187,913 discloses a steadying device for the stable physical positioning of a fire hose-nozzle assembly upon a building wall without requiring firemen to steady the assembly. Two winged portions of the steadying device hook to a wall. The back pressure from the discharged water forces the fire hose-nozzle assembly away from the wall thereby locking in place the winged portions of the steadying device.

U.S. Pat. No. 4,148,455 discloses a stand for a beach umbrella having a cavity for holding water, sand, or other ballast. A lid covers the cavity, and provides an orifice that snugly receives an umbrella pole therethrough with the base of the pole inserted in a recess at the bottom of the stand thereby providing securing means to maintain the umbrella in a vertical position.

U.S. Pat. No. 4,296,693 discloses an umbrella support formed from a collapsible container that can be filled with solid or liquid ballast. Umbrella retaining means are secured to the top of the container, and corner anchoring rods are secured in sleeves that are mounted to the vertical corner edges of the collapsible container.

U.S. Pat. No. 4,081,170 discloses a clamp to close off water flow in a pressure-fluid fire hose. The fire hose fits between upper and lower jaw members with the upper jaw capable of being forced toward the lower jaw by a fireman pushing downward on a handle that actuates a hydraulic drive system.

U.S. Pat. No. 1,512,003 discloses a combination fire hose clamp and carrier. The apparatus is designed to provide a simple means to quickly and securely attach to a fire hose and enable a fireman to carry or drag the fire hose to the desired location.

U.S. Pat. No. 596,689 discloses a holder that secures to a fire hose and provides handles that enable firemen to manipulate a nozzle attached to the end of the fire hose thereby directing water flow to extinguish a fire.

SUMMARY OF THE INVENTION

It is an object of this invention to provide a fire hose stabilizer which snugly receives a fire hose.

It is an object of this invention to provide a fire hose stabilizer to secure a pressurized fire hose thereby enabling one fireman to hold and manipulate a nozzle connected to the fire hose.

It is an object of this invention to provide a fire hose stabilizer that prevents an unattended pressurized fire hose from whipping around.

It is an object of this invention to provide a fire hose stabilizer with ballast means to anchor the nozzle end of a pressurized fire hose.

It is an object of this invention to provide a fire hose stabilizer with an aperture therethrough to receive a pressurized fire hose.

It is an object of this invention to provide a fire hose stabilizer with lifting means to enable a fireman to lift and carry the stabilizer.

DESCRIPTION OF PREFERRED EMBODIMENT

Figure 1:
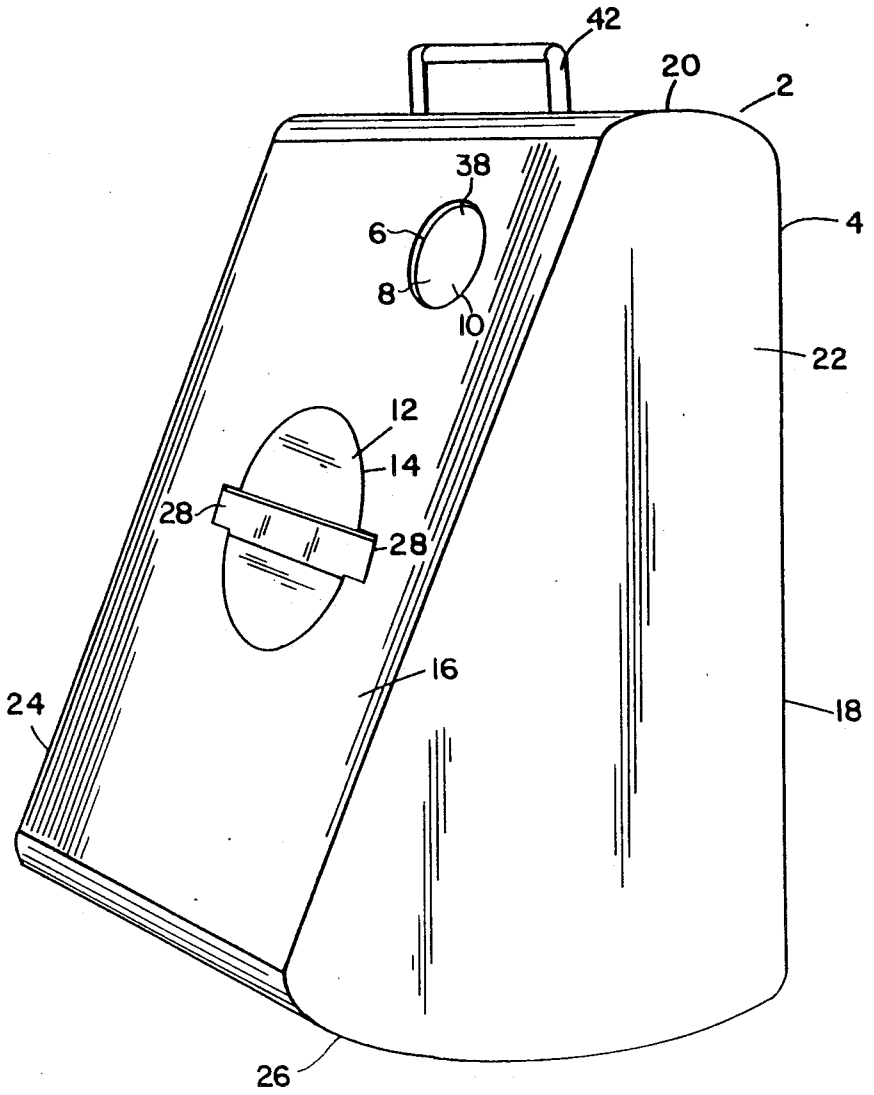
FIG. 1 is a perspective view of a fire hose stabilizer in accordance with this invention.
Figure 2:
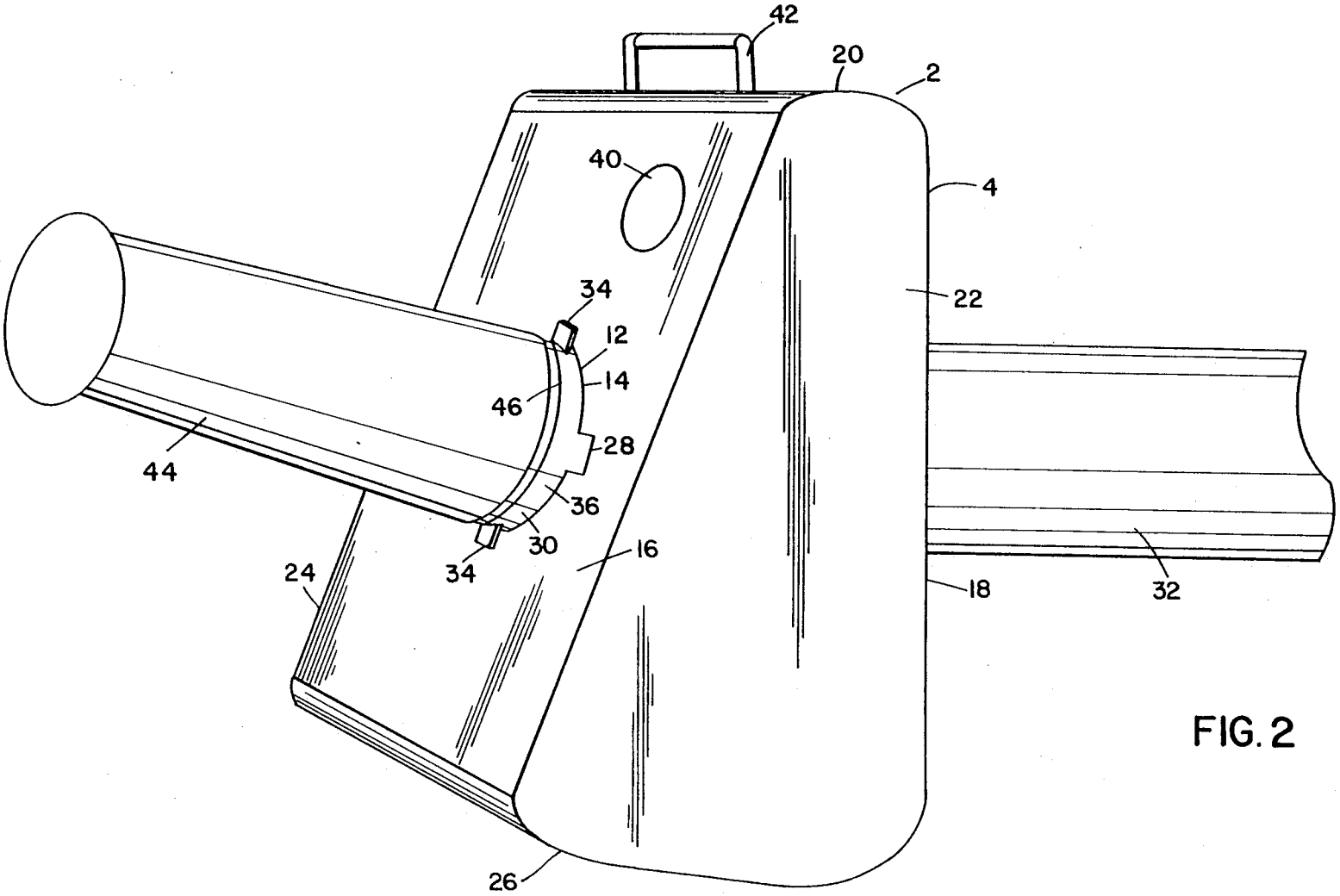
FIG. 2 is a perspective view of a fire hose stabilizer having a fire hose inserted therethrough with a nozzle and coupling attached to the end of the fire hose.
Figure 3:
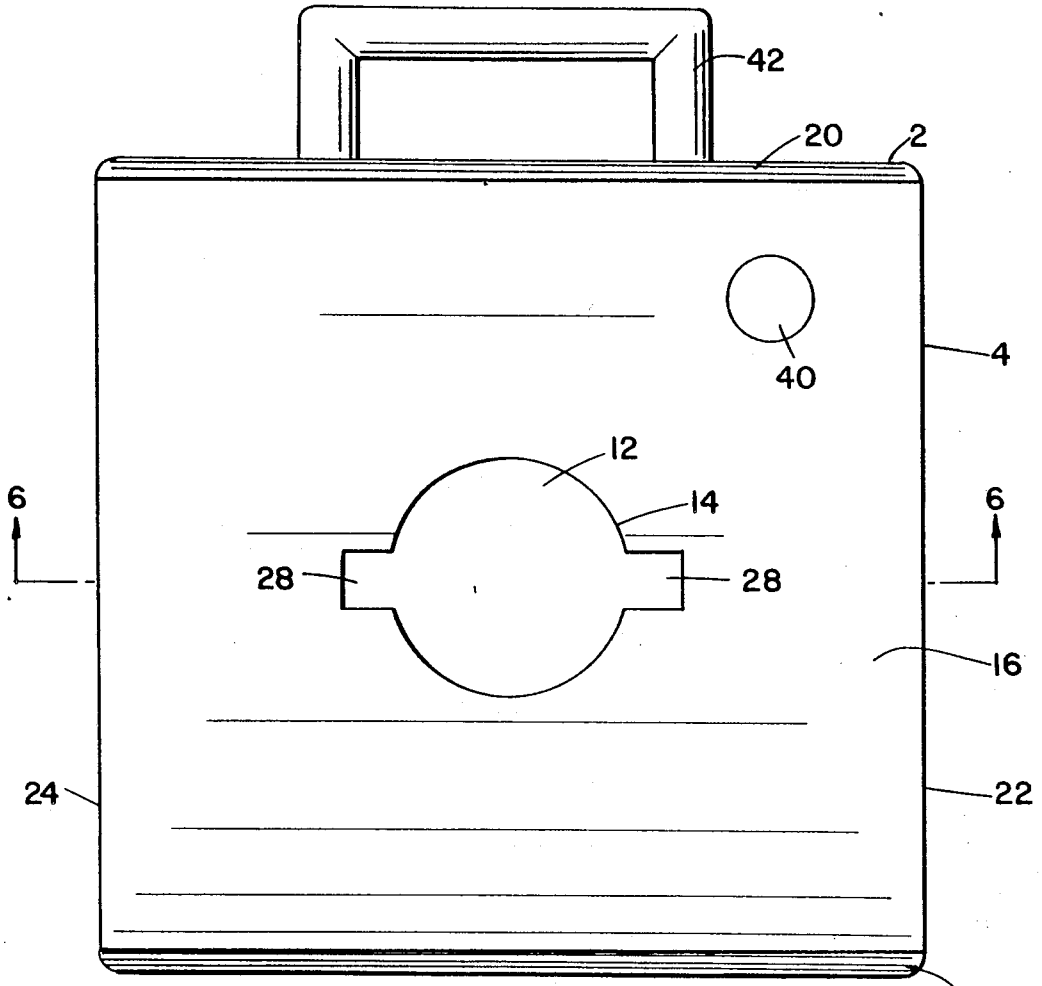
FIG. 3 is a front elevation view of the fire hose stabilizer shown in FIG. 1.
Figure 4:
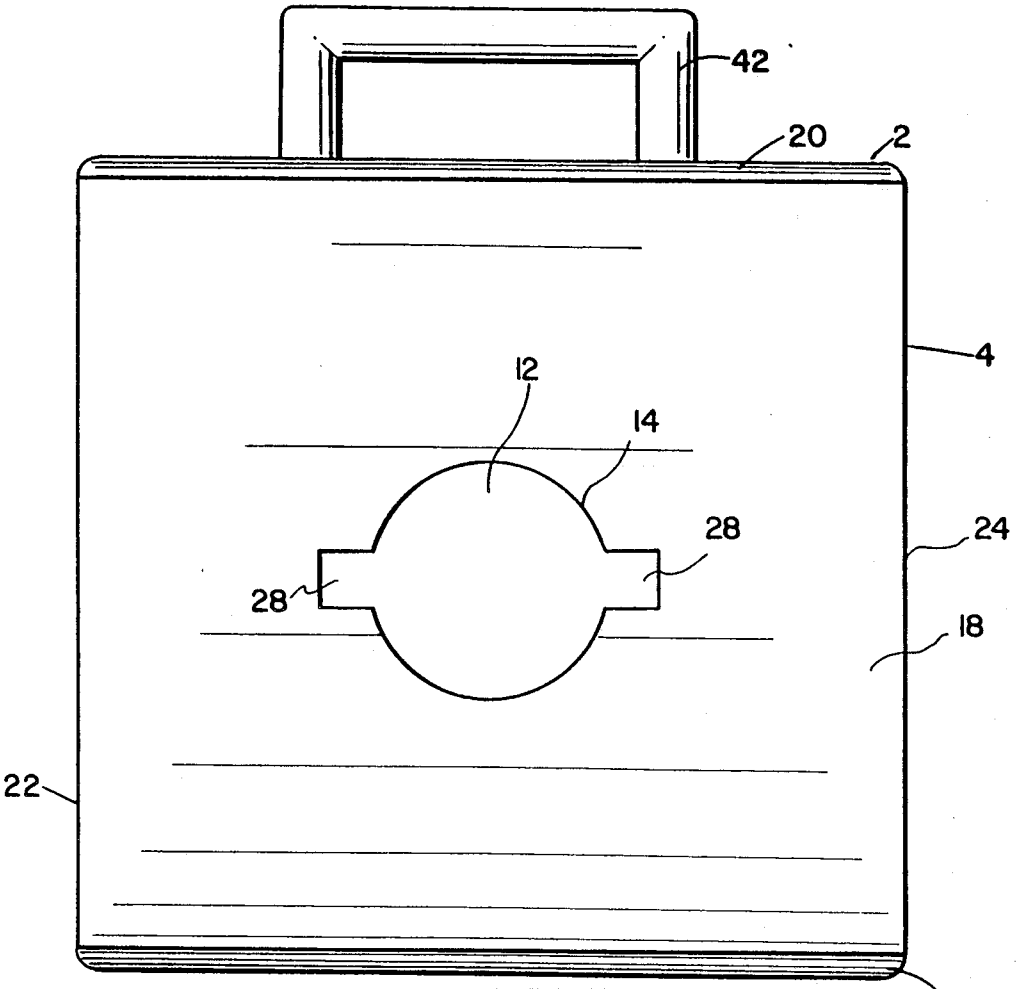
FIG. 4 is a rear elevation view of the fire hose stabilizer shown in FIG. 1.
Figure 5:
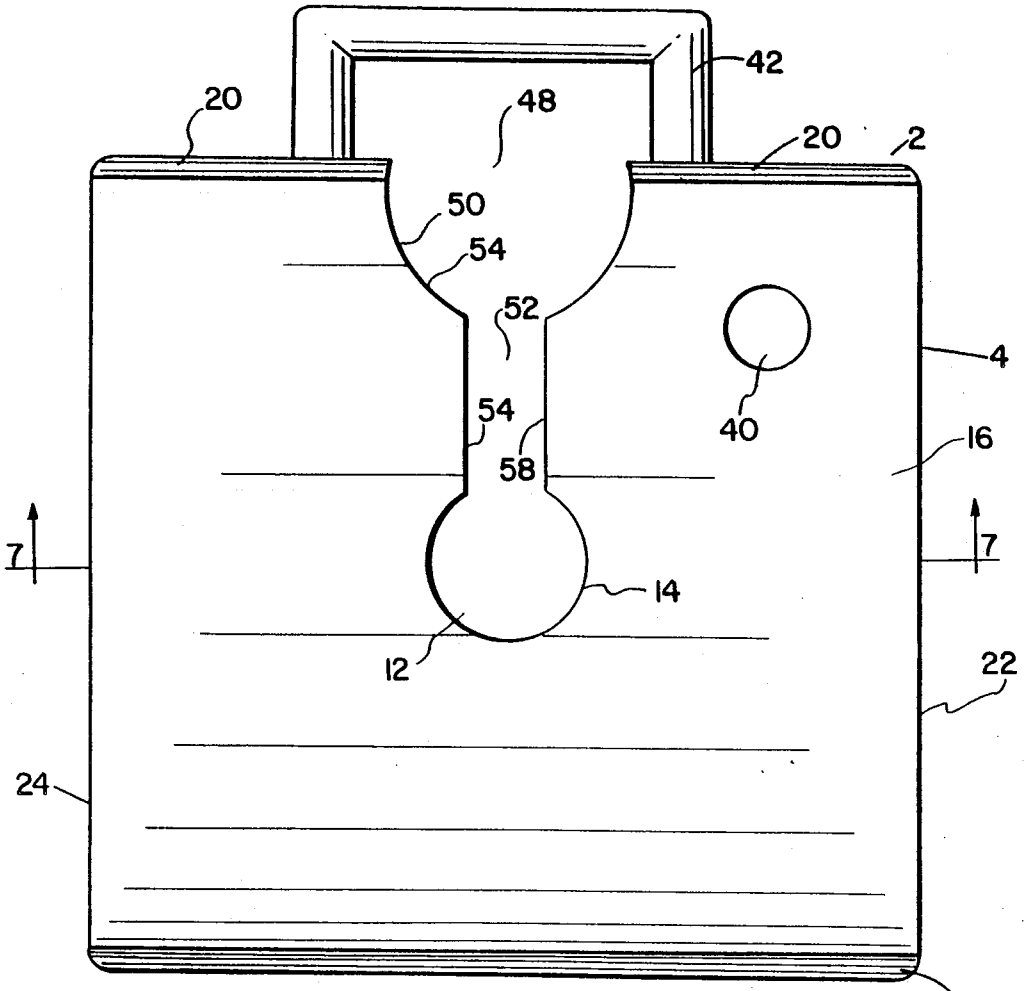
FIG. 5 is a front elevation view of a fire hose stabilizer having a hose aperture joined to a hose channel in accordance with this invention.
Figure 6:
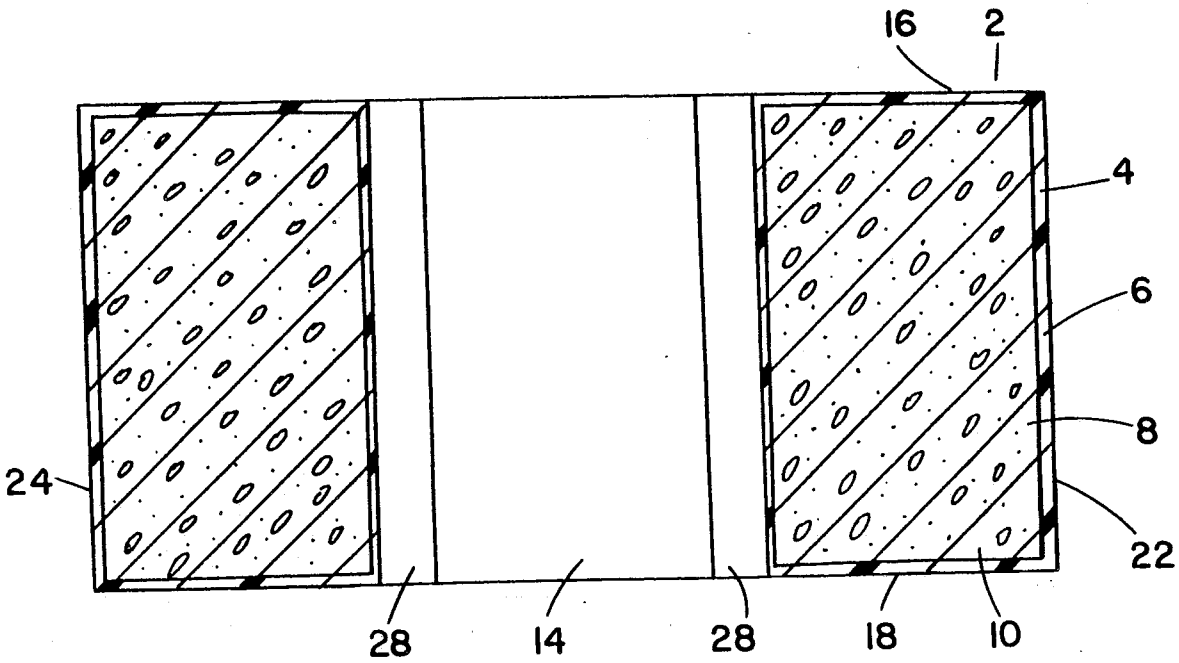
FIG. 6 is a section view taken on line 6—6 of FIG. 3 showing the cavity of the stabilizer shell filled with concrete.
Figure 7:
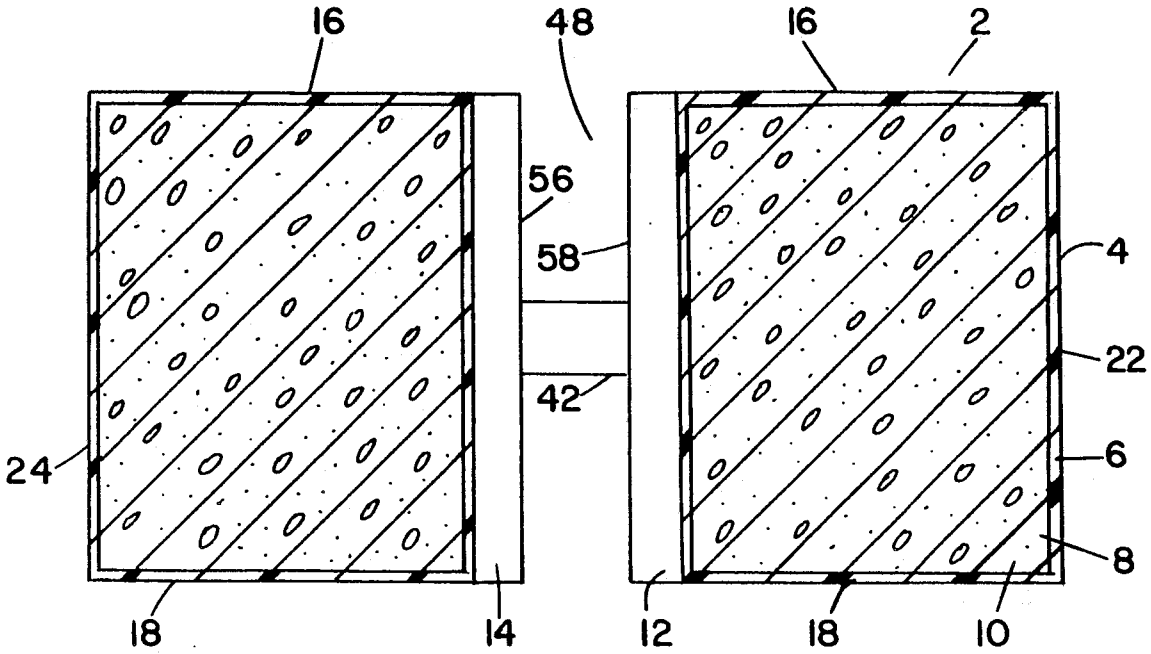
FIG. 7 is a section view taken on line 7—7 of FIG. 5 showing the cavity of the stabilizer shell filled with concrete.

A fire hose stabilizer 2 in accordance with the present invention includes a plastic shell 4 having plastic walls 6 encompassing a hollow chamber or cavity 8, a solid ballast material 10, and a hose aperture 12 extending through the shell 4 and isolated from the cavity 8 by a cylindrical wall 14 extending from the front wall 16 to the rear wall 18.

The shell 4 is wedge shaped with all walls having a thickness of approximately one-eighth inch. The top wall 20 of the shell 4 measures approximately two inches from the front wall 16 to the rear wall 18, and approximately fifteen inches from the first side wall 22 to the second side wall 24. The bottom wall 26 measures approximately seven inches from the front wall 16 to the rear wall 18 and approximately fifteen inches from the first side wall 22 to the second side wall 24.

The hose aperture 12 is substantially centered through the shell 4 to provide a radial restraining feature to the shell 4 when the shell 4 is filled with a ballast material 10 thereby preventing the nozzle end of the fire hose 32 from lateral and radial movement in all radial directions.

Two slots 28 are positioned adjoining the perimeter of the hose aperture 12, diametrically apart, and extend from the rear wall 18 of the shell 4 to the front wall 16 with the longitudinal axes of the slots 28 parallel to the longitudinal axis of the hose aperture 12. The cross-sectional configuration and dimensions of the hose aperture 12 is slightly larger than the cross-sectional configuration and dimensions of a coupling 30 attached to a pressurized fire hose 32. The location, cross-sectional configuration, and dimensions of the slots 28, when viewed from the front wall 16 of the shell 4, are slightly larger than the corresponding location, cross-sectional configuration, and dimensions of two lugs or finger projections 34 integrally mounted to the outer cylindrical wall 36 of the coupling 30 with the projections 34 positioned diametrically apart to allow the coupling 30 to insert through the hose aperture 12 and the projections 34 to insert through the slots 28.

A snug fit must be maintained between the coupling 30 and the cylindrical wall 14 of the hose aperture 12 to prevent the coupling 30 and nozzle 44 from being forced backward through the hose aperture 12 due to the back pressure of the water discharged through the nozzle. Therefore, for each fire hose 32 of varying diameter, a respective fire hose 32 stabilizer having an hose aperture 12 of slightly larger diameter must be fabricated.

The shell 4 has a fill aperture 38 in the front wall 16 to allow a flowable ballast material 10 such as concrete to be poured into the shell 4 and thereafter solidify. The weight of the shell 4 should be at least seventy pounds after the ballast material 10 has been added. The shell 4 should be completely filled with the ballast material 10 to insure that the ballast material 10 extends radially around and outward from the cylindrical wall 14 that circumferentially surrounds the fire hose 32 adjacent the nozzle 4 to distribute the weight of the ballast material 10 around the fire hose 32 to provide resistance against lateral and radial movement in all radial directions from the cylindrical wall 14 to thereby restrain the nozzle end of the pressurized fire hose 32 through the hose aperture 12 from whipping in any direction. A cover 40 is included for the fill aperture 38 to prevent any ballast material 10 from falling out of the shell 4.

A handle 42 is integrally joined to the top wall 20 of the shell 4 to allow a fireman to lift the shell 4 and ballast material inserted therein, and carry the fire hose stabilizer 2 to any desired location.

The fire hose stabilizer 2 operates by first filling the plastic shell 4 with a ballast material 10 via the fill aperture 38 until the shell 4 is completely filled and weighs at least seventy pounds, and then sealing the fill aperture 38 with a cover 40. A coupling 30 having a fire hose 32 attached thereto, and finger projections 34 extending radially outward from the outer cylindrical wall 36 of the coupling 30 is inserted through the hose aperture 12 and slots 28 in the rear wall 18 of the shell 4 and out the front wall 16. After the coupling 30 has passed through the hose aperture 12, the coupling 30 is rotated ninety degrees in either direction to place the finger projections 28 against the front wall 16 of the shell 4 thereby preventing the coupling from being pulled backwards through the hose aperture 12. A nozzle 44 is screwed on the threaded end 46 of the coupling 30 with the nozzle 44 in the closed position. The fire hose 32 is pressurized with water and the nozzle placed in the open position to discharge the water at the intended target. A fireman is not required to hold the fire hose 32 when water is discharged through the nozzle 44 while the stabilizer 2 is locked in place; although, a single fireman is capable of directing water flow in any direction.

An alternative design of the fire hose stabilizer 2 is shown in drawing 5. The stabilizer 2 has a smaller hose aperture 12 without adjoining slots 28 as detailed above; however, a hose channel 48 is added opening to the aperture 12 at one end and to the top wall 20 of the shell 4 at the opposite end.

The hose channel 48 has a coupling section 50 and a slip section 52. The coupling section 50 allows the coupling 30 with a fire hose 32 attached thereto to pass through the shell 4 between an arcuately shaped wall 54 and the handle 42. The slip section 52 allows the fire hose 32 to slide into the hose aperture 12 whereupon the aforementioned operating procedure is repeated.

The coupling section 50 includes an aperture through the top wall 16 and bottom wall 18 of the shell 4 and isolated from the shell cavity 8 by an arcuately shaped wall 54 extending from the front wall 16 to the rear wall 18. The arcuately shaped wall 54 opens to the slip section 52 that joins the hose aperture 12 to the coupling section 50. The slip section 52 forms a narrow passage from the rear wall 18 to the front wall 16 and is isolated from the cavity 8 within the shell 4 by two vertical walls 56 and 58 extending from and perpendicular to the front wall 16 and rear wall 18, and parallel to the first side wall 22 and second side wall 24 of the shell 4.

The distance between the vertical walls 56 and 58 of the slip section 52 is large enough to allow a depressurized fire hose 32 to easily slide from the coupling section 50 to the hose aperture 12. However, when pressurized, the fire hose 32 is locked in the hose aperture 12 due to the aperture 12 being slightly larger than the fire hose 32 yet smaller than the coupling 30 to prevent the coupling with the nozzle 44 attached thereto from being forced backwards through the hose aperture 12 due to the developed back pressure when the nozzle 44 is opened. Further, the distance between the vertical walls 56 and 58 of the slip section 52 is substantially smaller than the diameter of the fire hose 32 when pressurized to prevent the pressurized fire hose 32 from sliding through the slip section 52 and into the coupling section 50.

We claim:

1. A fire hose stabilizer for attachment to one end of a fire hose comprising a holder having an aperture therethrough to receive one end of a fire hose with a coupling attached thereto, retaining means to prevent said end of said fire hose and said attached coupling from withdrawing from said aperture, and separate ballast means receivable by said holder to maintain said end of said fire hose stationary during use.

2. A fire hose stabilizer as set forth in claim 1, wherein said separate ballast means receivable by said holder includes concrete or iron slag to provide weight to said holder thereby keeping said end of said fire hose stationary after said ballast means has been received by said holder.

3. A fire hose stabilizer for attachment to one end of a fire hose comprising a holder having an aperture therethrough to receive one end of a fire hose with a coupling attached thereto, retaining means to prevent said end of said fire hose and said attached coupling from withdrawing from said aperture, and ballast means to maintain said end of said fire hose stationary, wherein said holder includes an enclosure having a cavity therein, a cylindrical wall extending through said enclosure to isolate said aperture from said cavity, a wall aperture through one wall of said enclosure to allow ballast material to be inserted in said cavity, and cover means to cover said wall aperture thereby sealing said ballast material in said cavity of said enclosure.

4. A fire hose stabilizer for attachment to one end of a fire hose comprising a holder having an aperture therethrough to receive one end of a fire hose with a coupling attached thereto, retaining means to prevent said end of said fire hose and said attached coupling from withdrawing from said aperture, and ballast means to maintain said end of said fire hose stationary, wherein said retaining means includes a plurality of finger projections integrally joined to an outer wall of said coupling, a plurality of slots joined to said aperture and extending through said holder to receive said finger projections thereby allowing said coupling and said end of said fire hose to insert through said holder, said coupling then being rotated to a position whereby said finger projections are not in registration with said slots.

5. A fire hose stabilizer comprising ballast support means to support radially extending ballast means around and outwardly from the circumference of a fire hose adjacent its nozzle connecting end, and retaining means to retain said ballast support means and ballast means in a position relative to said fire hose, wherein said ballast support means comprises a housing having a through channel extending therethrough substantially centered therein and a chamber surrounding said through channel to receive said radially extending ballast means therein.

6. A fire hose stabilizer as set forth in claim 5, wherein said retaining means to retain said ballast support means and ballast means in said position relative to said fire hose includes a said through channel having a cross-sectional configuration and dimension corresponding to that of a said fire hose to be received therein when said fire hose is flowing water therethrough to hold said housing snugly to said fire hose.

7. A fire hose stabilizer as set forth in claim 6, wherein said through channel having said cross-sectional configuration and dimension corresponding to that of a said fire hose to be received therein comprising said retaining means includes radially extending through slots opening to said through channel comprising said retaining means, said through slots extending through said housing, the number, location, cross-sectional configuration and dimension of said through slots corresponding to the number, location, cross-sectional configuration and dimension of outwardly projecting lugs of a nozzle coupling member on said nozzle connecting end of said fire hose to enable passage of said nozzle connecting end having said nozzle coupling member through said through channel and said through slots of said retaining means, said housing including spaced apart forwardly facing and rearwardly facing walls, said through channel and said through slots opening to both said forwardly and rearwardly facing walls, said forwardly facing wall providing abutment surfaces for said outwardly projecting lugs of said nozzle coupling member to bear against when received through said through channel and said through slots of said retaining means and then rotated out of registration with said through slots to prevent said nozzle connecting end of said fire hose to slip backwardly and out of said through channel and said through slots of said retaining means.

8. A fire hose stabilizer as set forth in claim 5, wherein said ballast means includes flowable materials for pouring into said housing through an inlet aperture in said housing, to completely fill said chamber surrounding said through channel and to thereafter solidify, including said inlet aperture, the weight of said solidified materials being distributed around said through channel to provide resistance against lateral and radial movement in all radial directions from said through channel to thereby restrain the said nozzle connecting end of a said fire hose received through said through channel from whipping.

9. A fire hose stabilizer for attachment to one end of a fire hose comprising a holder having an aperture therethrough to receive one end of fire hose with a coupling attached thereto, channel means extending through said holder and joined to said aperture, said channel means including a coupling member to allow said end of said fire hose and said coupling to insert through said holder, said channel means including a slip member to allow said end of said fire hose to slide from said coupling member to said aperture retaining means to prevent said end of said fire hose and said attached coupling from withdrawing from said aperture, and ballast means to maintain said end of said fire hose stationary.

10. A fire hose stabilizer as set forth in claim 9, wherein said retaining means includes said aperture having cross-sectional configuration and dimensions smaller than the cross-sectional configuration and dimensions of said coupling attached to said fire hose.

* * * * *